US005860241A

United States Patent [19]

Waters

[11] Patent Number: 5,860,241

[45] Date of Patent: Jan. 19, 1999

[54] ELECTRONIC GUN LOCK

[76] Inventor: Michael A. Waters, 372 Bateman Cir. North, Barrington Hills, Ill. 60010

[21] Appl. No.: 880,821

[22] Filed: Jun. 23, 1997

[51] Int. Cl.[6] ..... F41A 17/04; F41A 17/06; F41A 17/44

[52] U.S. Cl. ..... 42/70.11; 42/66

[58] Field of Search ..... 42/70.11, 66, 70.01

[56] References Cited

U.S. PATENT DOCUMENTS

| | | | |
|---|---|---|---|
| 2,327,334 | 8/1943 | Parker | 42/66 |
| 2,479,107 | 8/1949 | Garretson | 42/70.11 |
| 2,887,807 | 5/1959 | Santangelo | 42/70.11 |
| 2,937,666 | 5/1960 | Maisch | 42/70.11 |
| 3,720,014 | 3/1973 | Goodrich | 42/70.11 |
| 3,768,189 | 10/1973 | Goodrich | 42/70.11 |
| 3,939,679 | 2/1976 | Barker et al. | 70/277 |
| 4,398,366 | 8/1983 | Wernicki | 42/70.11 |
| 5,001,854 | 3/1991 | Derman | 42/70.11 |
| 5,022,175 | 6/1991 | Oncke et al. | 42/66 |
| 5,289,653 | 3/1994 | Szebeni et al. | 42/70.11 |
| 5,398,438 | 3/1995 | Williams | 42/70.11 |
| 5,491,918 | 2/1996 | Elmstedt | 42/70.11 |

*Primary Examiner*—Stephen M. Johnson
*Attorney, Agent, or Firm*—Fitch, Even, Tabin & Flannery

[57] ABSTRACT

An electronic gun lock for a firearm which includes an electronic lock enclosure, a locking shaft member, and an optional locking shell. The locking shell, if used, is disposed within a bullet chamber of the firearm, and is adapted to fit both the firearm's bullet chamber and the locking shaft member. The locking shaft member includes an axially moveable elongated locking rod which is moveable between an unlocked position where the locking rod is slidable with respect to the locking shell (or bullet chamber if no locking shell is used) and a locked position where the locking rod is restrained against axial movement with respect to the locking shell (or bullet chamber). A releasable actuator contactly engages and moves the locking rod between the unlocked position and the locked position. A solenoid includes a moveable arm and is responsive to a control signal to cause the moveable arm to allow the actuator to move the locking rod between the unlocked position and the locked position. An electronic combination code decoder is provided for decoding a sequence code entered through a pair of combination pushbutton code switches and for generating the control signal allowing the solenoid to be energized when the sequence code is correct.

20 Claims, 5 Drawing Sheets

ELECTRONIC GUN LOCK

BACKGROUND OF THE INVENTION

1. Field of the Invention

This invention relates generally to gun locking devices and more particularly, it relates to an electronic gun lock for preventing unauthorized use of a gun, revolver, and the like which includes a solenoid responsive to a control signal and an electronic combination code decoder for decoding a sequence code and for generating the control signal causing the solenoid to be energized thus allowing a locking rod to be moved to the unlocked position.

2. Description of the Prior Art

A prior art search directed to the subject matter of this application in the U.S. Patent and Trademark Office revealed the following U.S. Letters Patent:

U.S. Pat. Nos. 2,479,017 4,398,366 2,887,807 5,001,854 3,768,189 5,022,175

In U.S. Pat. No. 3,768,189 issued on Oct. 30, 1973, to Robert S. Goodrich, there is disclosed a firearm barrel lock which is formed of a combination lock body having three tumbler rings. A collar is disposed in front of the lock body and is slidable outwardly away therefrom when the tumbler rings are appropriately set to open the lock. The collar can then be rotated with respect to the lock body so as to expand or contract an expandable member. When the expandable member is compressed so as to cause it to frictionally engage the barrel of the firearm, the firearm barrel lock is prevented from removal, thereby eliminating unauthorized use of the firearm.

In U.S. Pat. No. 4,398,366 issued on Aug. 16, 1983, to John J. Wernicki, there is taught a gun lock for a gun and is comprised of a dummy round rear member, a hollow intermediate rod, and a combination lock. The dummy member fits in a bullet chamber of the gun and includes locking ball receiving recesses for receiving locking balls disposed on the inner end of the intermediate rod. The intermediate rod has a slidably moveable central actuator with a cam end portion for forcing the locking balls radially outward to engage the recesses in the dummy member. The intermediate rod also includes circumferential recesses into which the locking balls can fall when the actuator is pressed in to move the cam portion. The combination lock abuts the outer end of the intermediate rod so as to prevent axial movement thereof toward the inner end of the intermediate rod, thereby insuring locking engagement of the locking balls with the locking ball receiving recesses.

In U.S. Pat. No. 5,022,175 issued on Jun. 11, 1991, to Ockert P. H. Oncke et al., there is illustrated a safety arrangement for selectively disabling a firearm and consists of a control unit, an electronic decoder unit, an electronic driver stage, and a keypad unit. The control unit is adapted in the locked condition to lock the hammer mechanically against actuation by the trigger and in the unlocked condition to unlock the hammer to be actuable by the trigger for firing. The electronic decoder unit is adapted to decode input signals received from the keypad and to provide corresponding output signals. The electronic driver stage is adapted on receipt of the output signals from the electronic decoder unit to cause corresponding operation of the control unit for locking or unlocking the hammer. The keypad unit has a number of key buttons whose operation thereof functions to provide the input signals to the electronic decoder unit.

The remaining patents listed above but not specifically discussed are merely cited of general interest and to show the state of the art in the field of gun locking devices.

None of the prior art uncovered in the search disclosed an electronic gun lock for preventing unauthorized use of a revolver or other firearm like that of the present invention which includes a solenoid having a moveable arm and being responsive to a control signal for energization so as to cause the moveable arm to allow an actuator pin to move an axially moveable elongated locking rod between a free position and a locked position. An electronic combination code decoder is provided for decoding a sequence code entered through a pair of code switches for generating the control signal allowing the solenoid to be energized when the sequence code is correct.

SUMMARY OF THE INVENTION

Accordingly, it is a general object of the present invention to provide an improved electronic gun lock for preventing unauthorized use of a firearm which is relatively simple in its construction, but yet can be operated faster than the conventional mechanical gun locks and cannot be mechanically picked.

It is an object of the present invention to provide an electronic gun lock which includes a solenoid having a moveable arm and being responsive to a control signal to cause the moveable arm to allow an actuator pin to move a locking rod between a free position and a locked position.

It is another object of the present invention to provide an electronic gun lock which includes an electronic combination code decoder for decoding a sequence code entered by a pair of code switches and for generating a control signal allowing a solenoid to be energized when the sequence code is correct.

It is still another object of the present invention to provide an electronic gun lock which includes a combination code decoder for decoding a sequence code which is programmable by a user through a pair of code switches.

In a preferred embodiment of the present invention, there is provided an electronic gun lock for a firearm having a barrel with a bore therein and a bullet chamber aligned with the bore of the barrel. The electronic gun lock includes a locking shell and a locking shaft member. The locking shell is disposed within the bullet chamber. The locking shaft member includes an axially moveable elongated locking rod which is moveable between an unlocked position where the locking rod is slidable with respect to the locking shell and a locked position where the locking rod is restrained against axial movement with respect to the locking shell.

The locking shaft member may be sized such that no locking shell is required for the smallest caliber of firearm which the electronic gun lock is designed for. For example, the size and shape of the locking shaft member may be such that no locking shell is needed for use of the electronic gun lock with 0.22 caliber firearms. In such case, the locking rod will interact with the shoulder of the bullet chamber itself to perform its locking function.

A releasable actuator pin is provided for contactly engaging and for moving the locking rod between the unlocked position and the locked position. A solenoid is provided which includes a moveable arm and is responsive to a control signal so as to cause the moveable arm upon its energization to allow the actuator pin to move the locking rod between the unlocked position and the locked position. An electronic combination code decoder is provided for decoding a sequence code entered through a pair of code switches and for generating the control signal thereby allowing the solenoid to be energized when the sequence code is correct.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figures 1, 2:
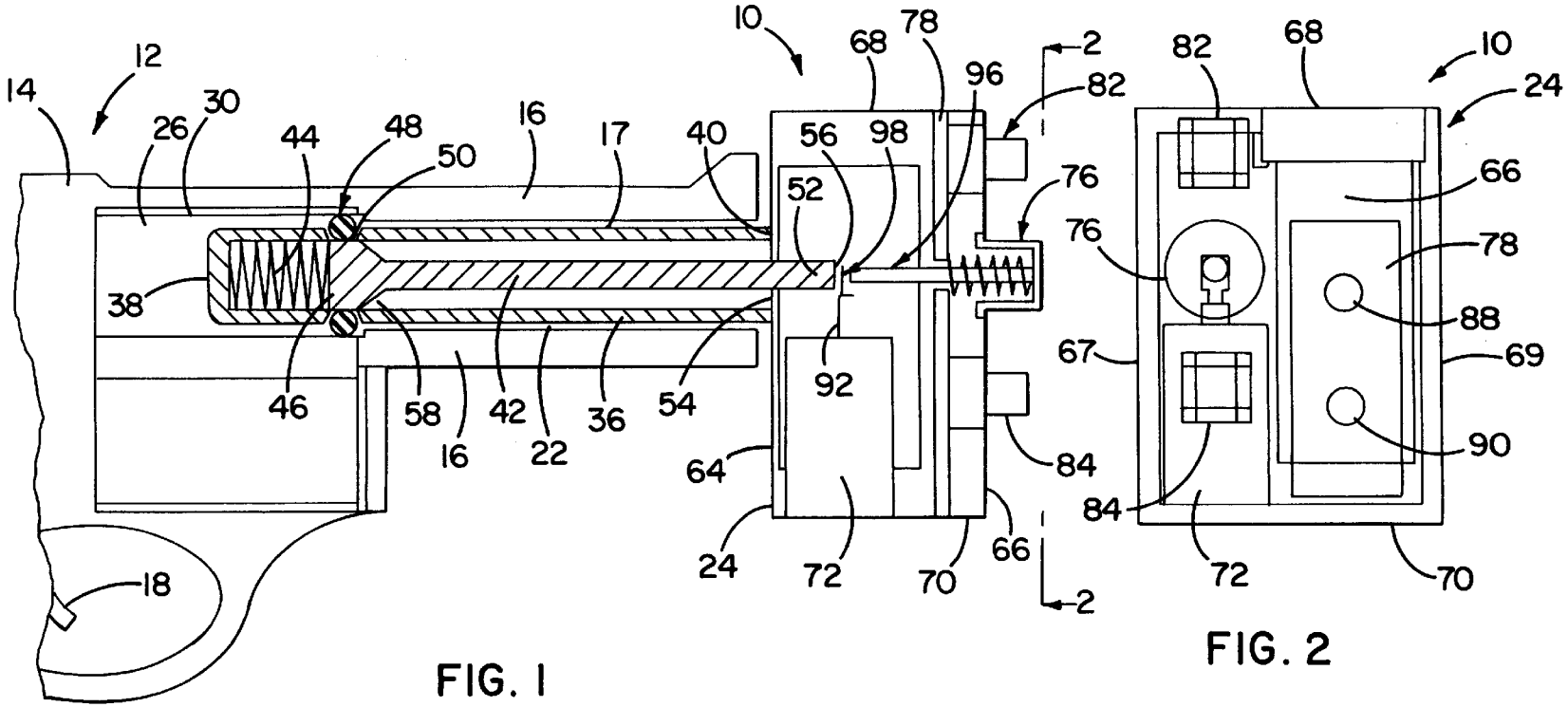
FIG. 1 is a side elevational view of an electronic gun lock, constructed in accordance with the principles of the present invention.
FIG. 2 is an end view of the electronic gun lock, taken along the lines 2—2 of FIG. 1.
Figure 3:
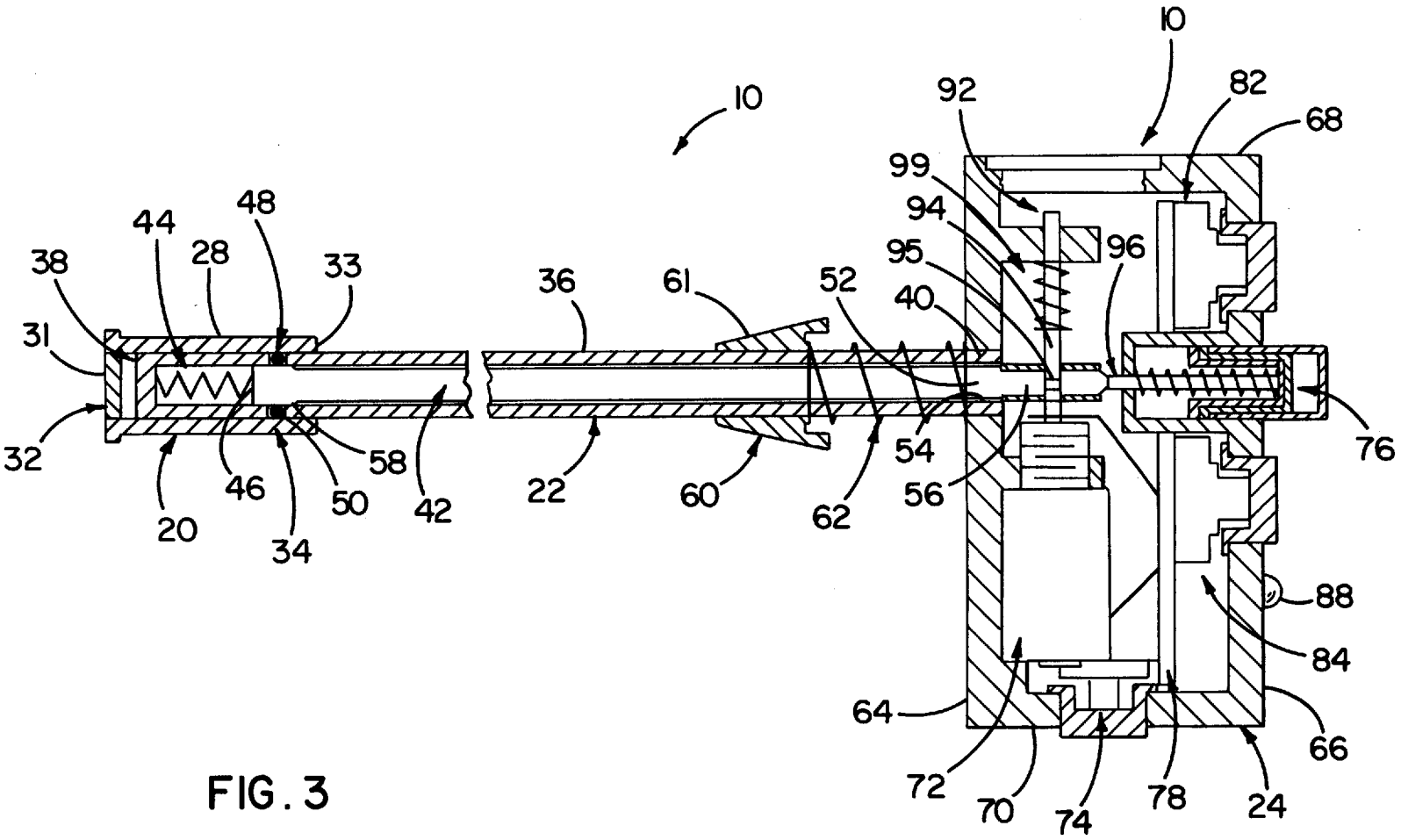
FIG. 3 is an enlarged, side cross-sectional view of an alternative embodiment of an electronic gun lock constructed in accordance with the principles of the present invention.

Referring now in detail to the various views of the drawings, there is illustrated in FIG. 1 a side elevational view of an electronic gun lock 10 constructed in accordance with the principles of the present invention. The electronic gun lock 10 is adapted to be employed with a firearm 12 so as to prevent its unauthorized use. Although FIG. 1 shows the electronic gun lock 10 with a conventional revolver, it is to be understood that the electronic gun lock of the present invention may be adapted for use with a wide variety of firearms. The firearm 12 includes a body 14, a barrel 16, and a trigger 18. As can be seen in FIG. 1 and 3, the electronic gun lock 10 is comprised of an optional locking shell 20 (not shown in FIG. 1), an intermediate locking shaft member 22, and an electronic lock enclosure 24 which are adapted to engage with each other so that the locking shaft member extends through the bore 17 of the barrel 16 of the firearm and into the bullet chamber 26. As illustrated in FIG. 1, the electronic gun lock 10 may use an intermediate locking shaft member 22 which is sized such that use of the locking shell 20 is not required. In such circumstances, the locking shaft member 22 interacts directly with the shoulder of the bullet chamber 26. Otherwise, as illustrated in FIG. 3, the locking shaft member 22 is held in a locked position by the electronic lock enclosure 24 so that the locking shell 20 will be fixedly retained within the bullet chamber 26. As a result, the gun lock of the instant invention cannot be removed from the firearm 12 after it has been installed without entering the correct electronic combination code sequence stored in the electronic lock enclosure 24. Thus, security has been provided so as to prevent opening and unauthorized use of the firearm 12.

As can be seen from FIG. 3, the locking shell 20 is formed of a substantially cylindrical shape having an outer surface 28 and is dimensioned so as to fit tightly in the bullet chamber 26 in the magazine cylinder 30 of the firearm 12 in which the gun lock 10 is to be installed. The locking shell 20 has a first end 31 which is closed by an annular flange 32. The flange 32 serves to restrict the foremost insertion of the locking shell 20 into the bullet chamber 26. The locking shell also has an open second end 33 for receiving the locking shaft member 22. Adjacent the second end, there is provided a locking ball-receiving groove 34 formed on the inner wall of the locking shell 20.

As can be seen in FIGS. 1 and 3, the locking shaft member 22 includes an elongated outer cylinder member 36 having a closed end 38 which is dimensioned to be received within the second opened end 33 of the locking shell 20 (FIG. 3) or directly within the bullet chamber 26 (FIG. 1) and having a second end 40 fixedly secured to the electronic lock enclosure 24. An axially moveable elongated locking rod 42 is disposed coaxially within the interior of the outer cylinder member 36. A locking rod-spring 44 has its one end engaging the inside surface of the closed end 38 of the cylinder member 36 and its other end engaging a first end 46 of the locking rod 42. Adjacent the front end of the locking rod 42 there are provided two or more locking balls 48 disposed in corresponding recesses 50 formed in the elongated outer cylinder member 36. The locking balls 48 are moveable radially between a free position where the balls are received wholly in the recesses 50 and a locked position, as shown in FIGS. 1 and 3, where the balls extend from the surface of the locking shaft member 22 and into the groove 34 formed in the locking shell 20 (FIG. 3) or against the shoulder of the bullet chamber 26 (FIG. 1). The interaction of the groove 34 (or the shoulder of the bullet chamber 26) and the locking balls 48 thus serves to restrain axial movement of the locking shaft member 22 relative to the firearm 12.

The locking rod has a second end 52 which extends through an opening 54 in the enclosure 24 and terminates in an actuator-engaging portion 56. The first end 46 of the locking rod 42 has a cam portion 58 adjacent the recesses 50 for engaging the locking balls 48 in order to urge the balls radially out toward the locked position (as shown in FIGS. 1 and 3) when the actuator-engaging portion 56 of the locking rod is moveable away from the closed end 38 of the outer cylinder member 36 (to the right in FIGS. 1 and 3) and to allow the balls to return to the free position when the actuator-engaging portion of the rod is moveable towards the closed end 38 of the outer cylinder member 36.

The outer cylinder member 36 and the locking rod 42 are preferably made of a relatively hard metallic material so as to make it difficult to cut or for drilling open the gun lock 10. The flange 32 of the locking shell 20 is preferably formed of an elastomeric material so as to serve as a cushion, thereby preventing damage to the firing pin of the firearm. A centering cone 60 is disposed on the outer circumference of the locking shaft member 22 and is insertable into the open end of the barrel 16 of the firearm. A cone-spring 62 has its one end engaging the centering cone and its other end engaging the side wall of the enclosure 24. When the gun lock 10 is installed, the cone-spring 62 will urge the tapering section 61 into the interior of the gun barrel 16 so as to insulate the locking shaft member 22 from the gun barrel in order to prevent damage thereto.

Figure 4A:
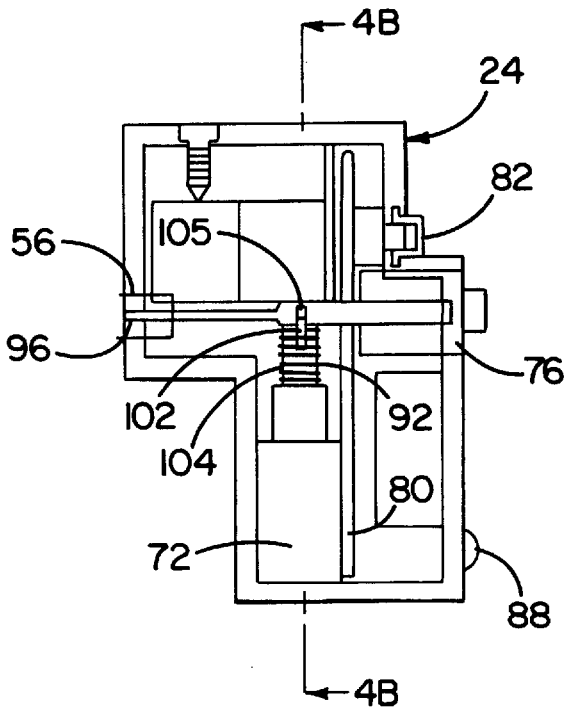
FIG. 4A is an enlarged, side cross-sectional view of the electronic lock enclosure section of an alternative embodiment of an electronic gun lock constructed in accordance with the principles of the present invention.
Figure 4B:
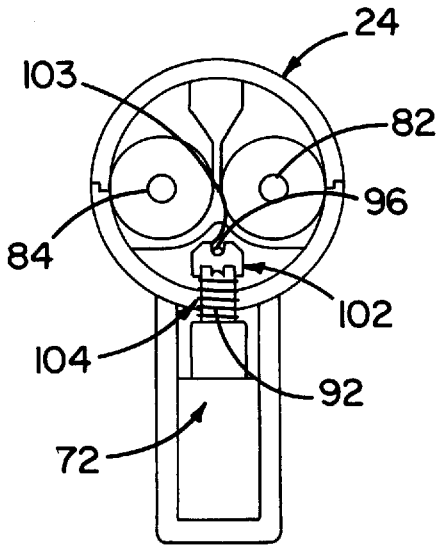
FIG. 4B is a cross-sectional view of the electronic gun lock, taken along the lines B—B of FIG. 4A.

As shown in FIGS. 1–3, the electronic lock enclosure 24 may be generally of a rectangular box construction formed by walls 64, 66, 67, 68, 69, and 70 (not all walls are shown in each Figure) all suitably connected together. As shown in FIGS. 4A and 4B, however, a wide range of shapes for enclosure 24 are within the scope of this invention. The enclosure 24 is preferably formed of a solid metallic material such as aluminum, steel, and the like. The enclosure is used to house a solenoid 72, a power switch 74 (which may be omitted in alternative embodiments as discussed below), a pen click mechanism 76, a printed circuit board 78 having mounted thereon electronic decoder circuitry 80, a pair of code switches 82 and 84, a battery 86, a green LED indicator 88, and a red LED indicator 90. Alternative embodiments of the electronic lock enclosure 24 consistent with the present invention may include additional security features such as an audible alarm means.

Figure 5:
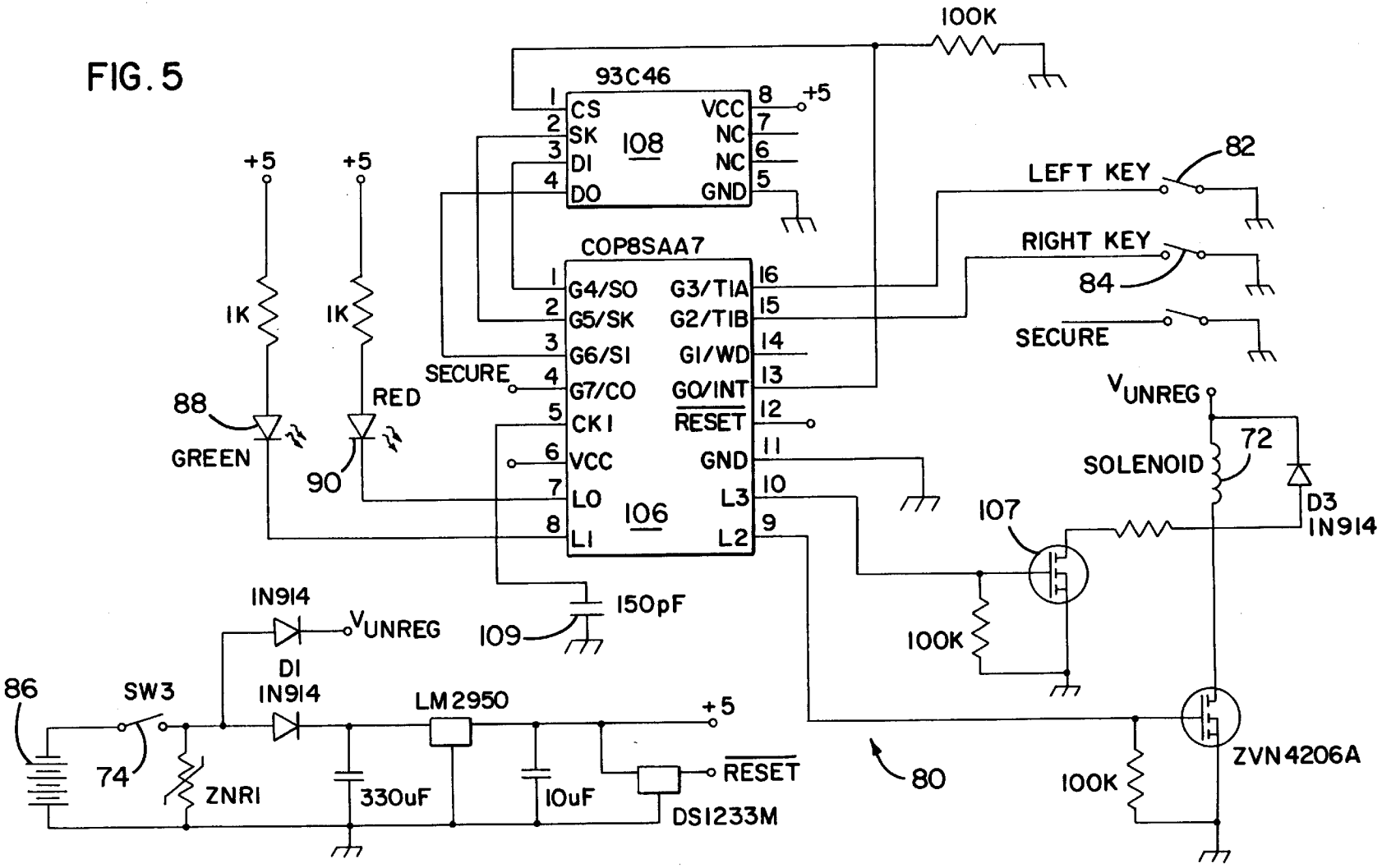
FIG. 5 is a schematic circuit diagram of the circuitry for controlling the operation of the electronic gun lock in accordance with the present invention.

As shown in FIG. 5, the solenoid 72 is powered by the battery 86 through the power switch 74. The power switch is used to disconnect the battery from the solenoid when the gun lock is not being used in order to eliminate draining of the battery. In an alternative embodiment of the present invention, this power saving function may be accomplished through the code switches 82 and 84 instead of a power switch 74. In such an alternative embodiment, the battery is disconnected until the first code switch is pushed to complete the battery circuit. The device will then draw power only until a timer times out.

The solenoid 72 includes a moveable arm 92. The interaction between the movable arm 92, the actuator-engaging portion 56 of the locking rod 42, and the actuator pin 96 of the pen click mechanism 76 are central to the operation of the locking mechanism of the present invention. It is to be understood that this interaction may be accomplished by a variety of means and still remain within the scope of this invention. The three such methods of interaction that are described herein merely serve as examples.

FIG. 1 illustrates one embodiment of the interaction among the movable arm 92, the actuator-engaging portion 56 of the locking rod 42, and the actuator pin 96 of the pen click mechanism 76. In this embodiment, the movable arm 92 is attached to a blocking gate 98, and the actuator-engaging portion 56 of the locking rod 42 may merely be the end of said locking rod. When the solenoid 72 is deenergized, the blocking gate 98 is positioned to prevent the actuator pin 96 of the pen click mechanism 76 from making contact with the actuator-engaging portion 56 of the locking rod 42. Any attempt to depress the pen click mechanism 76 is thus blocked. When the solenoid 72 is energized, however, the movable arm 92 moves the attached blocking gate 98 downward to allow contact between the actuator-engaging portion 56 of the locking rod 42 and the actuator pin 96 of the pen click mechanism 76. Now the pen click mechanism 76 may move and thereby cause the locking rod 42 to move with or against the locking rod-spring 44.

FIG. 3 illustrates a second embodiment of the interaction among the movable arm 92, the actuator-engaging portion 56 of the locking rod 42, and the actuator pin 96 of the pen click mechanism 76. In this embodiment, the solenoid 72 includes a moveable arm 92 having an aperture 94. The actuator-engaging portion 56 of the second end of the locking rod 42 extends through the aperture 94 and includes a narrower diameter portion 95. The aperture 94 is shaped such that the actuator-engaging portion 56 of the locking rod 42 may move axially through the aperture, or the aperture may be aligned to mate with the narrower diameter portion 95 of the actuator-engaging portion to prevent such axial movement. When the solenoid 72 is energized, the moveable arm 92 will cause the aperture 94 to become aligned such that free axially movement of the locking rod is possible. Thus, the actuator pin 96 of the pen click mechanism 76 will be engageable with the actuator-engaging portion 56 on the second end of the locking rod 42 through the aperture 94 so as to move the locking rod toward and away from the closed end 38 of the locking shaft member for locking or unlocking respectively the gun lock. When the solenoid is not energized, a solenoid-spring 99 will urge the movable arm 92 back to a position where the aperture 94 mates with the narrower diameter portion 95 of the actuator-engaging portion 56 of the second end of the locking rod 42. Therefore, the actuator-engaging portion 56 on the second end of the locking rod cannot be activated by the actuator pin 96.

FIGS. 4A and 4B illustrate a third embodiment of the interaction among the movable arm 92, the actuator-engaging portion 56 of the locking rod 42, and the actuator pin 96 of the pen click mechanism 76. In this embodiment, the solenoid 72 includes a moveable arm 92 having a latch 102, with a notch 103, and a solenoid spring 104, and the actuator-engaging portion 56 of the locking rod 42 is fixably attached to the actuator pin 96 of the pen click mechanism 76 such that they form one continuous piece. This combined actuator/locking rod has a recessed groove 105 that is sized to be capable of mating with notch 103 of latch 102. When the solenoid 72 is deenergized, the solenoid spring 104 will force the notch 103 of latch 102 on moveable arm 92 to mate with recessed groove 105, thereby preventing axial motion of the combined actuator/locking rod unit. When the solenoid 72 is energized, however, the solenoid 72 will pull the moveable arm 92 so as to overcome the force of the solenoid spring 104, thereby decoupling the latch 102 from the combined actuator/locking rod unit and thus allowing the pen click mechanism 76 to move the combined actuator/locking rod unit to move with or against the locking rod-spring 44.

The energization of the solenoid 72 is controlled by the electronic decoder circuitry 80. When the correct sequence of a code is entered by depressing the code pushbutton switches 82 and 84, the solenoid is energized so as to pull the moveable arm 92 and thereby allow the pen click mechanism 76 to be depressed to lock and unlock the gun lock in the manner described above. A detailed schematic circuit diagram of the electronic decoder circuitry 80 is illustrated in FIG. 5 of the drawings.

The electronic decoder circuitry 80 includes an I.C. chip 106 which is a decoder such as COP85AA7 with input pins 16 and 15 for receiving a code sequence. The decoder has the ability to detect an out of sequence entry or incorrect entry. The I.C. chip 106 checks the sequence to determine if it is correct or not via its sequential detector and sequential memory formed therein.

In order to install the gun lock 10 onto the barrel 16 of the firearm 12, the power switch 74 on the enclosure 24 is initially depressed and held down (this step may be unnecessary/not applicable in alternative embodiments discussed above). A combination code is entered by depressing the code pushbutton switches 82 and 84 in a particular sequence. If the sequence is correct, a high or logic "1" will appear on pin 10 of 106. This high will turn on the field-effect transistor 107 so as to cause the solenoid 72 to be energized. The pen click mechanism 76 must be depressed within two seconds after the correct sequence is entered so as to move the actuator pin 96 to engage and move the locking rod 42 toward the closed end 38 of the locking shaft member 22. As a result, the locking balls 48 will be moved along the cam portion 58 and can fall wholly into the recesses 50. Then, the locking shell 20 can be removed from the closed end 38 of the locking shaft member 22 and the locking shaft member is now capable of insertion into the gun barrel 16. Also, the red LED indicator 90 will be lit so as to indicate that the electronic gun lock 10 is unlocked and the firearm 12 may be capable of firing. The power switch 74 can now be released, thereby disconnecting the battery 86 (or in alternative embodiments without a power switch 74, the battery 86 will be disconnected by the electronic decoder circuitry 80 once an electronic timer times out after the last code switch 82 or 84 is depressed). The pen click mechanism 76 will remain latched in the "open" position until it is depressed again.

Next, the locking shell 20 is inserted into the bullet chamber 26 in the same manner that a bullet would be loaded into the firearm 12 (use of the locking shell 20 may be unnecessary, however, if the size of the locking shaft member 22 is manufactured to correspond with the particular caliber of the given firearm 12). The intermediate locking shaft member 22 now may be inserted into the gun barrel 16 so that its closed end 38 is received in the open end 33 of the locking shell 20 (or directly into the bullet chamber 26 if no locking shell is used) and the tapered end 61 of the centering cone 60 is engaged with the interior of the barrel adjacent the open end thereof. Then, the pen click mechanism 76 is depressed so as to cause the actuator pin 96 to move away from closed end 38 of the outer cylinder member 36, thus allowing the locking rod 22 to also be moved away from the closed end 38 by means of the locking rod-spring 44. Consequently, the locking balls 48 will be moved along the cam portion 58 thereby forcing the locking balls 48 to protrude radially out from the surface of the locking shaft member 22 through recesses 50 and into the groove 34 in the inner wall of locking shell 20 (or directly against the shoulder of the bullet chamber 26 if no locking shell is used). Thus, the locking rod 42 will be in the "closed" or locked position, locking it with the locking shell 20 (or bullet chamber 26). This can be verified by lightly pulling on the locking shaft member 22 away from the open end of the barrel 16. Finally, the power switch 86 is depressed to check that the green LED indicator 88 is lit, indicating that the gun lock in the "locked" or secured position.

In this manner, an unauthorized person will not be able to unlock the firearm 12 and use the same without first knowing and entering the correct sequence code into the electronic decoder 106 for unlocking the electronic gun lock 10. Since the combination code may be eight numbers in length in a particular sequence, there exists a large number of different codes which makes it very unlikely that any unauthorized person will be able to detect the correct code. Further, the security can be enhanced by requiring that the correct combination code be entered for a repeated certain number of times (i.e., three times) within a specified time period. The number of times that a code must be repeated is controlled by an I.C. chip 108 (93C46) which is fed into the decoder chip 106. Further, the amount of time allowed for entering the correct code is determined by the value of the capacitor 109 connected to pin 5 of the I.C. decoder chip 106. Moreover, the combination code is programmable by the user through the code pushbutton switches 82 and 84 when the gun lock is in the "open" position.

In order to eliminate tampering with the gun lock, an audible alarm may be optionally installed. Alternatively, the gun lock can be installed with a high electrifying voltage so as to provide a shock to the unauthorized person for preventing tampering.

Figure 6:
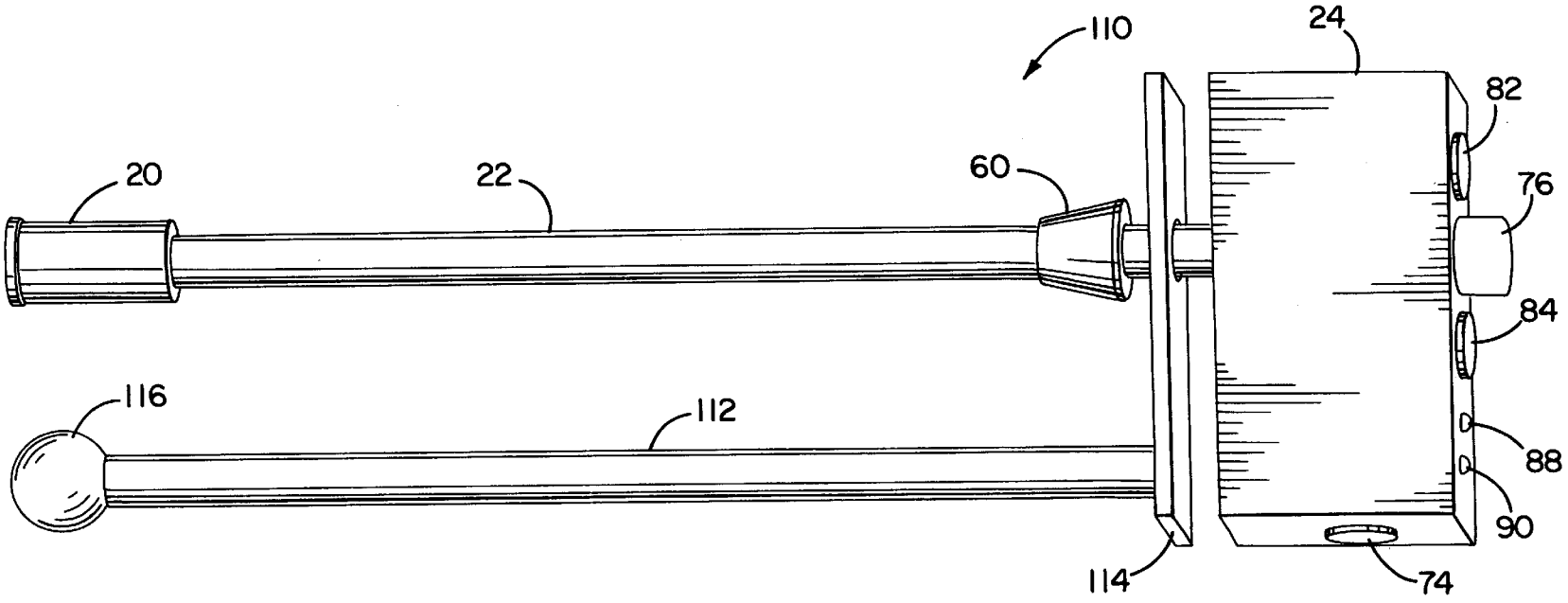
FIG. 6 is a side elevational view of a third embodiment of an electronic gun lock in accordance with the present invention.

In FIG. 6, there is shown a third embodiment of an electronic gun lock 110. The gun lock 110 is quite similar to the gun lock 10 of FIGS. 1–3 and further includes a second elongated locking rod member 112 having its one end connected to a mounting plate 114. The other free end thereof has a ball member 116 which is insertable into the firing chamber of a second barrel of a double-barrel gun. Thus, the gun lock 110 may be easily attached to lock both barrels of the double-barrel gun so as to prevent its unauthorized use. Except for these differences, the structural components and operation of the gun lock 110 is identical to FIGS. 1–3. Therefore, a more detailed explanation is not believed to be necessary.

From the foregoing detailed description, it can thus be seen that the present invention provides an improved electronic gun lock which includes a solenoid having a moveable arm and is responsive to a control signal for energization so as to cause the moveable arm to allow an actuator pin to move a locking rod between a locked position and an unlocked position. Further, there is provided an electronic combination code decoder for decoding a sequence code entered through a pair of code pushbutton switches and for generating the control signal allowing the solenoid to be energized when the sequence code is correct.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An electronic gun lock for a firearm having a barrel with a bore therein and a bullet chamber aligned with said bore of the barrel, comprising:

a locking shell formed of a substantially cylindrical shape and having an outer surface which is dimensioned to be received within said bullet chamber, said locking shell having a first end which is closed by an annular flange, a second end which is open, and a locking ball-receiving groove formed on its inner wall thereof adjacent the second opened end;

a locking shaft member having an axially moveable elongated locking rod disposed coaxially therein, said shaft member having a first closed end which is dimensioned to be received within the second opened end of said locking shell and a second end, said locking rod having a first end and a second end, where a spring means is disposed between said first end of said shaft member and said first end of said locking rod for urging said locking rod away from said first end of said shaft member;

two or more locking balls disposed adjacent said first end of said locking rod, said locking balls being moveable radially between a free position wherein said locking balls are disposed in corresponding recesses formed in said locking rod and a locked position where said locking balls extend from the surface of said locking rod and into said locking ball-receiving groove of said locking shell so that said locking shaft member is restrained against axial movement with respect to said locking shell by the interaction of said locking balls said locking-ball receiving groove;

actuator-engaging portion disposed adjacent said second end of said locking rod;

a releasable actuator pin for contactly engaging said actuator-engaging portion of said locking rod so as to move said locking rod between the free position and the locked position;

a solenoid having a moveable arm and being responsive to a control signal for energization to cause said moveable arm to allow said actuator pin to move said locking rod between the free position and the locked position; and electronic combination code decoder means for decoding a sequence code entered through a pair of combination code switches and for generating the control signal allowing said solenoid to be energized when the sequence code is correct.

2. An electronic gun lock as claimed in claim 1, further comprising a battery power source connected to said solenoid through a power switch.

3. An electronic gun lock as claimed in claim 2, wherein said power switch is selectively opened so as to disconnect said battery power source from said solenoid when said gun lock is not in use, thereby eliminating draining of the battery power source.

4. An electronic gun lock as claimed in claim 1, wherein said sequence code is programmable by user through said combination code switches.

5. An electronic gun lock as claimed in claim 1, wherein said annular flange of said locking shell is formed of an elastomeric material so as to function as a cushion to prevent damage to the firing pin if actuated.

6. An electronic gun lock as claimed in claim 1, further comprising a centering cone disposed on the outer circumference of said shaft member, said cone having a tapered portion for engaging the interior of said barrel so as to eliminate damage thereto by said shaft member.

7. An electronic gun lock as claimed in claim 6, further comprising cone-spring means disposed between an end opposite the tapered portion of said cone and the second end of said shaft member for urging said cone into the interior of said gun barrel.

8. An electronic gun lock as claimed in claim 1, wherein said moveable arm of said solenoid includes an aperture which allows said actuator-engaging portion of said locking rod to be moved by said actuator pin when said solenoid is engaged.

9. An electronic gun lock as claimed in claim 1, wherein said moveable arm of said solenoid includes a blocking gate which prevents said actuator-engaging portion of said locking rod to be moved by said actuator pin unless said solenoid is engaged.

10. An electronic gun lock as claimed in claim 1, wherein said moveable arm of said solenoid includes a solenoid spring and a latch, and said actuator and said locking rod are formed of one continuous piece which contains a recessed groove capable of mating with said latch, whereby said continuous actuator/locking rod cannot be moved by said actuator pin unless said solenoid is engaged.

11. An electronic gun lock as claimed in claim 1, wherein said locking rod is formed of a hard metallic material.

12. An electronic gun lock as claimed in claim 1, wherein said locking shaft means includes a second locking rod member adapted to be disposed in a second gun barrel of a double-barrel gun so as to prevent unauthorized use.

13. An electronic gun lock for a firearm having a barrel with a bore therein and a bullet chamber aligned with said bore of the barrel, comprising:

a locking shaft member having an axially moveable elongated locking rod disposed coaxially therein, said shaft member having a first closed end which is dimensioned to be received within the bullet chamber of said firearm and a second end, said locking rod having a first end and a second end, where a spring means is disposed between said first end of said shaft member and said first end of said locking rod for urging said locking rod away from said first end of said shaft member;

two or more locking balls disposed adjacent said first end of said locking rod, said locking balls being moveable radially between a free position wherein said locking balls are disposed in corresponding recesses formed in said locking rod and a locked position where said locking balls extend from the surface of said locking rod and into said bullet chamber so that said locking rod is restrained against axial movement with respect to said bullet chamber be means of the interaction between said locking balls and the shoulder of said bullet chamber;

actuator-engaging portion disposed adjacent said second end of said locking rod;

a releasable actuator pin for contactly engaging said actuator-engaging portion of said locking rod so as to move said locking rod between the free position and the locked position;

a solenoid having a moveable arm and being responsive to a control signal for energization to cause said moveable arm to allow said actuator pin to move said locking rod between the free position and the locked position; and electronic combination code decoder means for decoding a sequence code entered through a pair of combination code switches and for generating the control signal allowing said solenoid to be energized when the sequence code is correct.

14. An electronic gun lock as claimed in claim 13, further comprising a battery power source connected to said solenoid through a power switch.

15. An electronic gun lock as claimed in claim 14, wherein said power switch is selectively opened so as to disconnect said battery power source from said solenoid when said gun lock is not in use, thereby eliminating draining of the battery power source.

16. An electronic gun lock as claimed in claim 13, wherein said sequence code is programmable by user through said combination code switches.

17. An electronic gun lock as claimed in claim 13, wherein said moveable arm of said solenoid includes an aperture which allows said actuator-engaging portion of said locking rod to be moved by said actuator pin when said solenoid is engaged.

18. An electronic gun lock as claimed in claim 13, wherein said moveable arm of said solenoid includes a blocking gate which prevents said actuator-engaging portion of said locking rod to be moved by said actuator pin unless said solenoid is engaged.

19. An electronic gun lock as claimed in claim 13, wherein said moveable arm of said solenoid includes a solenoid spring and a latch, and said actuator and said locking rod are formed of one continuous piece which contains a recessed groove capable of mating with said latch, whereby said continuous actuator/locking rod cannot be moved by said actuator pin unless said solenoid is engaged.

20. An electronic gun lock as claimed in claim 13, wherein said locking rod is formed of a hard metallic material.

* * * * *